US007112037B2

(12) United States Patent
Sabini et al.

(10) Patent No.: US 7,112,037 B2
(45) Date of Patent: Sep. 26, 2006

(54) CENTRIFUGAL PUMP PERFORMANCE DEGRADATION DETECTION

(75) Inventors: Eugene P. Sabini, Skaneateles, NY (US); Jerome A. Lorenc, Seneca Falls, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 574 days.

(21) Appl. No.: 10/324,359

(22) Filed: Dec. 20, 2002

(65) Prior Publication Data

US 2004/0120804 A1 Jun. 24, 2004

(51) Int. Cl.
*F01B 25/26* (2006.01)
*F04D 29/00* (2006.01)

(52) U.S. Cl. ..... 415/118; 415/1; 415/17; 702/182; 702/183

(58) Field of Classification Search ..... 415/118, 415/1, 17, 26, 30, 47; 702/182–185, 145, 702/38, 45, 47, 50, 114
See application file for complete search history.

(56) References Cited

U.S. PATENT DOCUMENTS 6,330,525 B1 * 12/2001 Hays et al. ..... 702/183
6,564,627 B1 * 5/2003 Sabini et al. ..... 73/168
6,648,606 B1 * 11/2003 Sabini et al. ..... 415/1

* cited by examiner

*Primary Examiner*—Theresa Trieu
(74) *Attorney, Agent, or Firm*—Duane Morris LLP

(57) ABSTRACT

A system for determining whether a centrifugal pump assembly is degraded as operating outside of acceptable operating limits and includes a processor adapted by software to perform the steps of automatically characterizing the pump characteristics at a predetermined operating level and testing for degradation using the automatically acquired pump characteristics.

20 Claims, 7 Drawing Sheets

CENTRIFUGAL PUMP PERFORMANCE DEGRADATION DETECTION

RELATED APPLICATIONS

This application is directly related to Ser. No. 10/052,947, entitled, "Centrifugal Pump Performance Degradation Detection" filed on Jan. 17, 2002, which is incorporated herein by reference.

FIELD OF THE INVENTION

This invention relates generally to centrifugal pumps, and, more particularly, to an improved method and apparatus for determining degradation of a centrifugal pump.

BACKGROUND OF THE INVENTION

As is known, a centrifugal pump has a wheel fitted with vanes and known as an impeller. The impeller imparts motion to the fluid which is directed through the pump. A centrifugal pump provides a relatively steady fluid flow. The pressure for achieving the required head is produced by centrifugal acceleration of the fluid within the rotating impeller. The fluid flows axially towards the impeller, is deflected by it and flows out through apertures between the vanes. Thus, the fluid undergoes a change in direction and is accelerated. This produces an increase in the pressure at the pump outlet. When leaving the impeller, the fluid may first pass through a ring of fixed vanes, which surround the impeller, and is commonly referred to as a diffuser. In this device, with gradually widening passages, the velocity of the liquid is reduced, its kinetic energy being converted into pressure energy. Of course it is noted that in some centrifugal pumps there is no diffuser and the fluid passes directly from the impeller to the volute. The volute is a gradual widening of the spiral casing of the pump. Centrifugal pumps are well known and are widely used in many different environments and applications.

The prior art also refers to centrifugal pumps as velocity machines because the pumping action requires first, the production of the liquid velocity; second the conversion of the velocity head to a pressure head. The velocity is given by the rotating impeller, the conversion accomplished by diffusing guide vanes in the turbine type and in the volute case surrounding the impeller in the volute type pump. With a few exceptions, all single stage pumps are normally of the volute type. Specific speed $N_s$ of the centrifugal pump is $NQ^{1/2}/H^{3/4}$. Ordinarily, N is expressed in rotations per minute, Q in gallons per minute and head (H) in feet. The specific speed of an impeller is an index to its type. Impellers for high heads usually have low specific speeds, while those for low heads have high specific speeds. The specific speed is a valuable index in determining the maximum suction head that may be employed without the danger of cavitation or vibration, both of which adversely effect capacity and efficiency. Operating points of centrifugal pumps are extremely important.

Several common methods are employed in the prior art to monitor and detect when the centrifugal pump's performance degrades. One such technique operates on the fixed speed pump. The flow and total dynamic head (TDH) is measured when the pump is new. This information is stored as a graph, table or polynomial curve. As the pump ages, the flow and TDH are measured periodically and compared to the new flow and TDH. If the TDH at a given flow drops below a preset percentage, the pump has degraded to a level whereby the pump would have to be either replaced or rebuilt.

A second technique operates on a fixed speed pump. The flow and brake horsepower (BHP) is measured when the pump is new. The information is again stored as a graph, table or polynomial curve. As the pump ages, the flow and BHP are measured periodically and compared to the original flow and BHP. If the BHP at a given flow and the same speed has increased above a preset percentage, the pump and/or motor have degraded. Further investigation is needed to determine which rotating piece of equipment is in need on being repaired or replaced. This works well on pumpages whose specific gravity or viscosity does not change in time.

In the third instance, on a variable speed pump, the flow and TDH are measured at several speeds when the pump is new. This information is again stored in a series of graphs, tables or polynomial curves. As the pump ages, the speed, flow and TDH are measured periodically and compared to the original flow and TDH using the Affinity Law to convert the measurements to the nearest speed curve. If the TDH at a given flow drops below a preset percentage, the pump has degraded to an undesirable level. This level would indicate that a rebuilt pump is required or that the pump should be replaced.

In regard to the above, it is seen that certain of the methods require that four separate sensing devices (transducers) be purchased and permanently installed on the pump. These devices are to measure suction pressure, discharge pressure, temperature and flow. Therefore, as one can ascertain, the pressure measuring devices are typical pressure transducers, while temperature devices may be temperature sensitive elements, such as thermistors and so on, and flow measuring devices are also well known. The capital expenditures involved in installing and maintaining these sensors are expensive and substantially increase the cost of the unit.

Thus, as one can ascertain, the prior art techniques are expensive and require the use of additional sensing devices, which are permanently installed and become part of the pump.

One solution features the use of a variable speed drive (VSD) for the motor. The drive must have the ability to characterize the motor to obtain torque supplied by the motor and actual motor running speed. This feature is commonly included in most VSDs today. Also one additional pump sensor (differential pressure across the pump, pump discharge pressure or flow) needs to be installed. It is noted this method clearly has advantages over other existing approaches that are used today to determine pump performance degradation. It requires only one pump transducer as opposed to the four needed by some of the other systems. While more than adequately fit for its intended purpose and superior to any devices or procedures presently used today to determine pump performance degradation, this solution requires that the performance of the pump is known and that information must be entered into the device. Logistically, each device will have information unique only to one pump. The device will operate properly with only that one pump or at best that one model and size of pump. To attach the device to another pump would require re-programming of the new pump's hydraulic data into the device.

It is therefore an object of the present invention to provide an improved method and apparatus for detecting degradation performance of a centrifugal pump without employing excessive additional transducer devices and without the need for pump hydraulic information.

SUMMARY OF THE INVENTION

A system for determining degradation of the performance of a centrifugal pump assembly having a pump driven by a variable speed drive motor. The system includes a processor under the control of software having a routine for characterizing the pump torque and speed relative to a process variable set point. The software further includes a routine for testing for degradation of the pump performance relative to the characterized pump torque and speed.

BRIEF DESCRIPTION OF THE DRAWINGS

Other aspects, advantages and novel features of the invention will become more apparent from the following detailed description of the invention when considered in conjunction with the accompanying drawings wherein.

DETAILED DESCRIPTION

Figure 1:
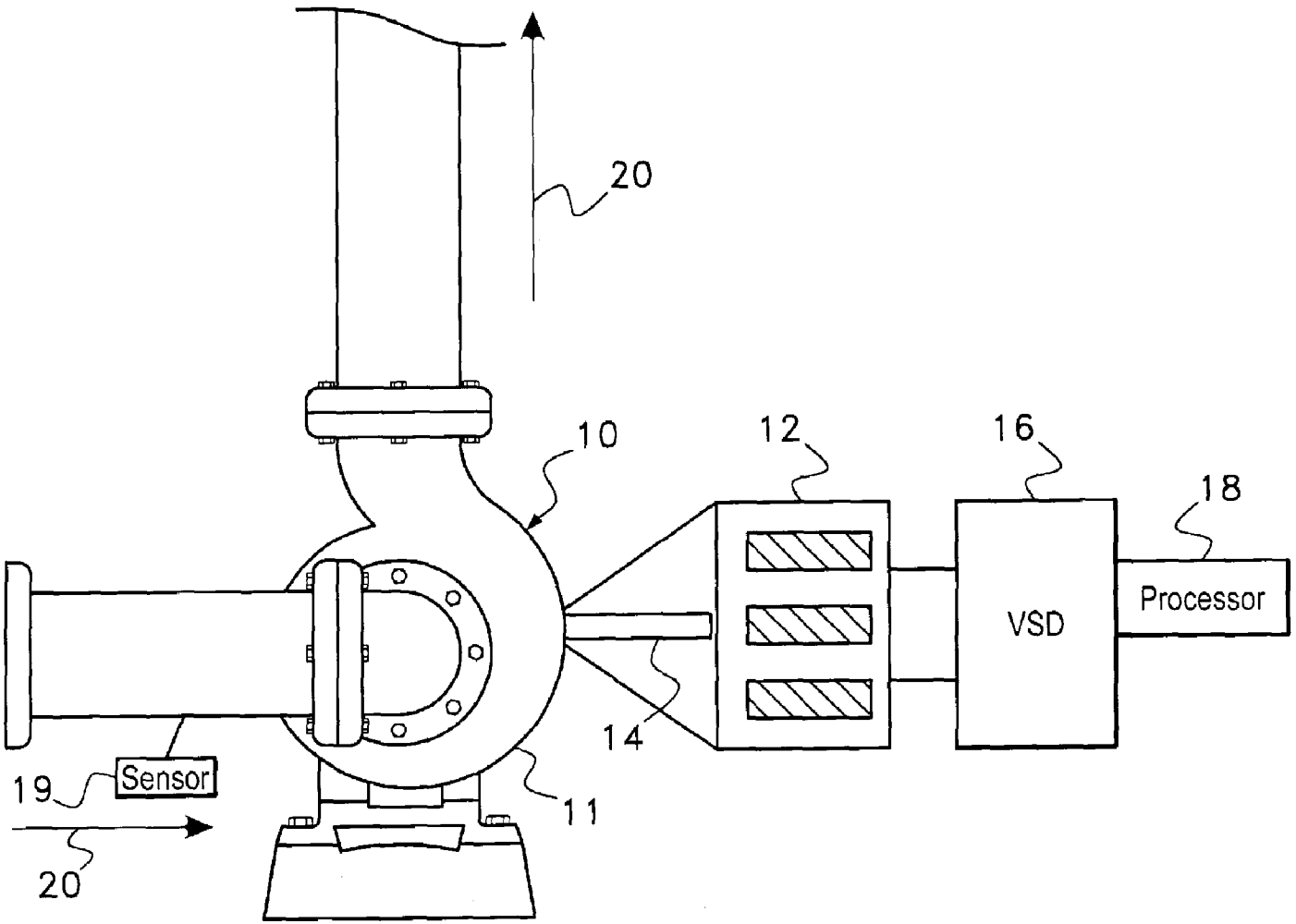
FIG. 1 is a schematic depicting a centrifugal pump driven by a motor having a variable speed drive according to an aspect of this invention.

Referring to FIG. 1, there is shown a schematic view of a typical centrifugal pump 10. The centrifugal pump 10 has a housing 11, which connects to a pump motor 12 via a central drive shaft 14. The pump motor 12 is connected to a variable speed drive 16, which in turn is controlled by a processor 18. In accordance with the present invention a process variable sensor 19 is incorporated into the output of the centrifugal pump to sense at least one pump parameter. As will be discussed in the remainder of this application the process variable sensor is a pressure sensor to monitor the discharge pressure of the pump. However, those skilled in the art will appreciate that other sensors such as differential pressure or flow sensors may be used without detracting from the principles of this invention.

Essentially, the arrow lines 20 show the flow of fluid through the centrifugal pump 10. The centrifugal pump provides a relatively steady flow. The pressure for achieving the required delivery head is produced by centrifugal acceleration of the fluid in the rotating impeller (not shown). Those skilled in the art will appreciate that the optimal operation of the pump is dictated by the characteristics of the flow process at which output pressure and flow rate is set to maintain liquefaction of the material being driven. In other words, if the pressure becomes too high in relation to other factors such as the material composition or operating temperature, the material may vaporize causing degradation of the flow and possibly necessitating shutdown of the process.

Desired pressure levels may be maintained by setting a pressure set point for the pump and may be controlled by the variable speed drive. Variable drive circuits for motor control are well known and essentially, an adjustable, varying speed motor is one where the speed can be adjusted. There are control circuits which control the speed of the motor by supplying a variable width and variable frequency signal which, for example, has a duty cycle and a frequency dependent on the current directed through the motor. Such control devices are implemented using current feedback to sense motor speed. Such circuits can control the speed of the motor by varying the pulse width as well as pulse frequency.

A variable speed drive (VSD), also referred to as a variable-frequency drive (VFD) or adjustable-speed drive (ASD), is a power-conversion device that varies the speed of a three-phase induction motor. The basic principle used by the VSD is to vary the frequency of its output, which, in turn, varies the speed of the motor.

VSDs have become an important component in building power systems from the standpoint of energy savings. Centrifugal pumps, as well as centrifugal and vane axial fans, have variable torque loads. The torque required to drive the fan or pump is proportional to the square of the speed. Since torque and horsepower (hp) are related to each other as a function of speed, the hp requirement is proportional to the cube of the speed.

This relationship indicates that if the speed of the fan or pump can be modulated, the hp required to drive the fan or pump increases or decreases by the cube of the speed. Therefore, the use of a VSD enables the delivery of only as much power to the motor as is required to drive the load at the desired level.

As shown in FIG. 1, there is a processor 18 which essentially may be included in the variable speed drive circuitry (VSD) 16 and is responsive to motor rotation or torque. Advantageously, the function of the processor, as will be explained, is to provide a means by which the pump may be tested for degradation without the need for preloading of the processor with data corresponding to the pump performance history.

This process of the present invention typically resides in the form of software adapted to operate the processor of the VSD or in a processor in signal communication with a VSD of the type adapted to receive commands from a remote processor. Additionally, the software could also reside in any programmable logic controller, computer or like device that could measure torque and speed between an adjustable speed drive (motor, turbine gearbox, etc) and pump, one process variable (such as, discharge pressure or flow) and be capable of varying the VSD's speed.

Figure 2:
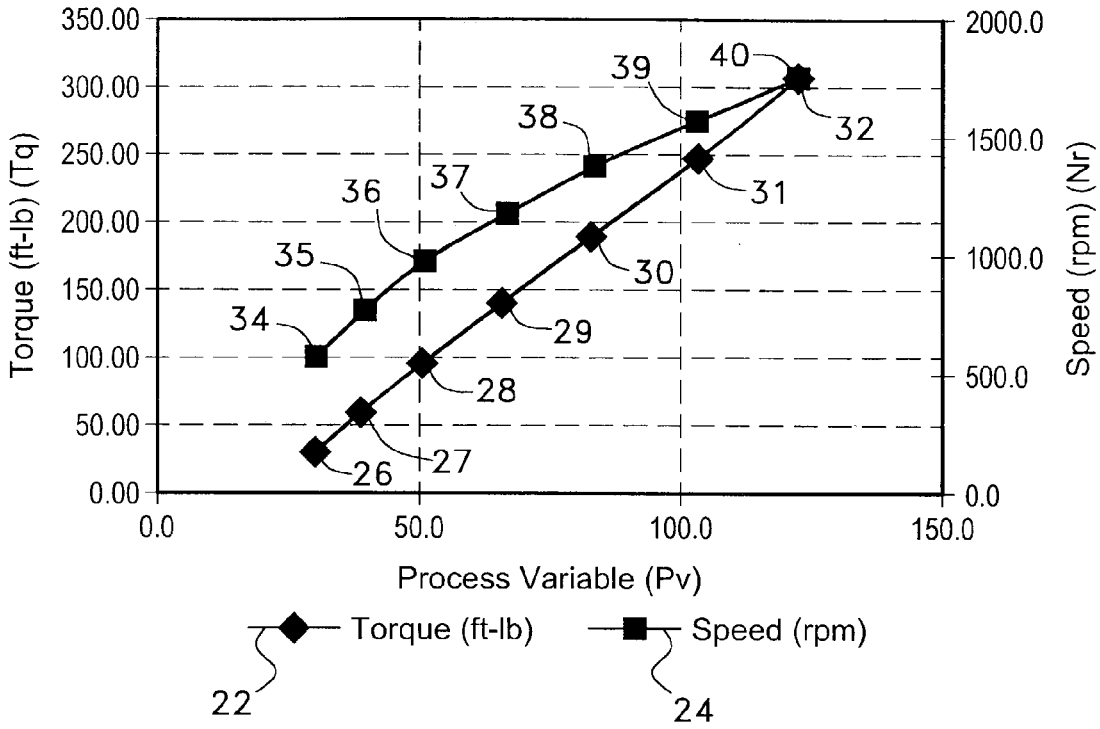
FIG. 2 is a graph depicting computation of a baseline slope of speed to torque ratios.

With reference to FIG. 2, the software begins on initial startup or, after startup upon request, to characterize the pump performance by reading and recording a process variable (Pv), such as pressure, driver to pump torque (Tq) and pump speed (Nr). Torque as used throughout this description refers to the torque measured in the mechanical link between the driver and pump. This is done at specific speed intervals until either the process variable set point has been reached or the maximum speed of the motor is achieved. A minimum of four data sets is preferred for adequate pump baseline information; however, additional data sets are desirable. For example, FIG. 2 illustrates a plot of a process variable versus torque 22 and process variable versus speed 24 (data points 26–32 for torque and data points 34–40 for speed) where seven data sets were recorded at speed intervals of 200 rpms from 600 rpms to approximately 1800 rpms. Using the tabulated data from startup, line fitting routines are applied to the data to determine a line function that describes the data for torque and speed by the process variable. For example, the process variable versus torque is a straight line function where discharge pressure is the process variable.

$$Tq=A*Pv+B$$

It will be appreciated by those skilled in the art that other curve fitting techniques may be used when the process variable is changed.

For the process variable (Pv) versus speed (Nr) a $2^{nd}$ order polynomial function is computed using conventional polynomial line fitting techniques such as polynomial iteration.

$$Nr=A*Pv^2+B*Pv+C$$

Using the functions for determining Pv vs Tq and Pv vs Nr, the torque (Tqset) and speed values (Nrset) at the process set point (Pvset) are identified as base data. Also, the values of torque ($Tqset_{@\pm5\%\ Pvset}$) and speed ($Nrset_{@\pm5\%\ Pvset}$) at plus/minus 5 percent of Pvset are derived to produce the following base data table.

| | | |
|---|---|---|
| Pvset − 5% | $Tqset_{@-5\%Pvset}$ | $Nrset_{@-5\%Pvset}$ |
| Pvset | Tqset | Nrset |
| Pvset + 5% | $Tqset_{@+5\%Pvset}$ | $Nrset_{@+5\%Pvset}$ |

Figure 3:
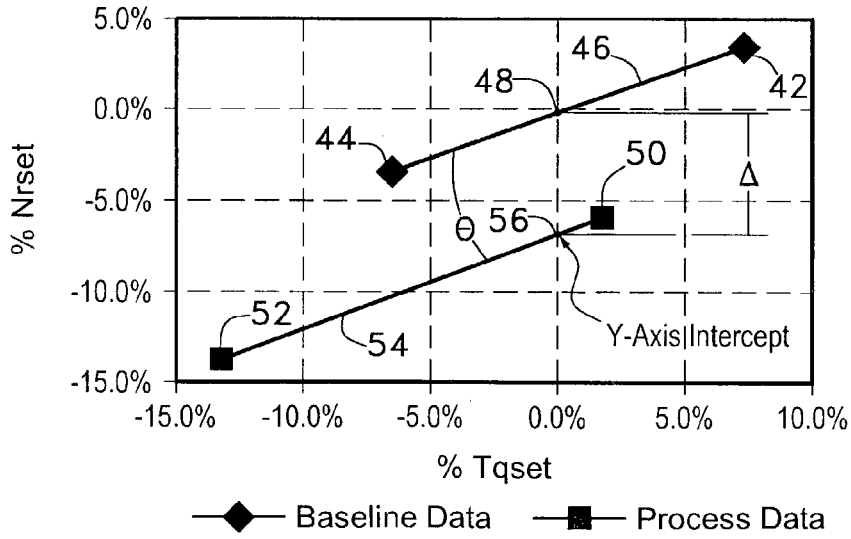
FIG. 3 is a graph depicting comparison of the baseline slope of FIG. 2 with a test slope.

With reference to FIG. 3, the percent change of torque versus speed (% Tq vs % Nr) are plotted using the values of percent change in torque and speed at plus/minus 5 percent of Pvset (% $Tqset_{@\pm5\%\ Pvset}$, % $Nrset_{@\pm5\%\ Pvset}$) computed as follows:

$$\%\ Tq\text{set}=(Tq\text{set}-Tq\text{set}_{@\pm5\%\ Pvset})/Tq\text{set}*100$$

$$\%\ Nr\text{set}=(Nr\text{set}-Nr\text{set}_{@\pm5\%\ Pvset})/Nr\text{set}*100$$

The coordinates for percent change high (% $Tqset_{@+5\%\ Pvset}$, % $Nrset_{@+5\%\ Pvset}$) 42 and percent change low (% $Tqset_{@-5\%\ Pvset}$, % $Nrset_{@-5\%\ Pvset}$) 44 are plotted and a baseline 46 extending between these two points is computed.

The ratio of the percent change in speed divided by the percent change in torque is the baseline slope. Also the intercept point 48 of the baseline to the y-axis, where the y-axis represents the percent change in speed, is computed and has been discovered to be generally at or near the zero value of percent change in speed. For a given pump at a given process set point, with changing suction pressure conditions (assuming adequate Net Positive Suction Head Available (NPSHa) conditions) and changing system conditions, the baseline slope is presumed not to change for a properly functioning pump.

Once the initial base data has been gathered and with continued reference to FIG. 3, the pump is periodically tested for degradation by dithering the pump (speed is increased and then decreased a chosen percentage above and below the set point value) and torque, speed and process variable data is collected at the process variable set point and the high and low dither speed points. The collected data is illustrated by the following table:

| | | |
|---|---|---|
| $Pvtest_{LOW}$ | $Tqtest_{LOW}$ | $Nrtest_{LOW}$ |
| $Pvtest_{SP}$ | $Tqtest_{SP}$ | $Nrtest_{SP}$ |
| $Pvtest_{HIGH}$ | $Tqtest_{HIGH}$ | $Nrtest_{HIGH}$ |

The base data for torque (Tqset) and speed (Nrset) are used as the reference to calculate the percent change in the test torque and speed respectively at the high and low dither points as follows:

$$\%\ Tq\text{test}=(Tq\text{set}-Tq\text{test}_{LOW/HIGH})/Tq\text{set}*100$$

$$\%\ Nr\text{test}=(Nr\text{set}-Nr\text{test}_{LOW/HIGH})/Nr\text{set}*100$$

The coordinates for percent change high (% $Tqtest_{HIGH}$, % $Nrset_{HIGH}$) 50 and percent change low (% $Tqtest_{LOW}$, % $Nrtest_{LOW}$) 52 are plotted and a test line 54 extending between these two points is computed.

A slope and intercept to the y-axis 56 are calculated for the test line 54. The slope of the test line should be within θ=5 degrees of the baseline slope, otherwise the data is assumed to have been taken during system or suction changes and is not valid. The difference (Δ) in the value of the baseline y-axis intercept and the test line y-axis intercept is what will determine whether the pump has degraded or not. For flow as the process variable, where the process sensor is a flow sensor, typically a Δ=3% or greater intercept indicates a degraded pump. With pressure as the process variable, where the process sensor is a pressure sensor, typically a Δ=6% or greater intercept value indicates a degraded pump. The above percentages can be increased in accordance with the operating conditions of the overall system to identify higher values of pump degradation. It should be noted that if a new process set point value exists, then the device should be instructed to recalculate the torque and speed base data values along with a new baseline slope value. These values are obtained from the tabulated data obtained during startup. The device then uses the new set point values for the process variable, torque and speed and compares them to the actual torque and speed measurements from the pump during degradation testing.

Figure 4:
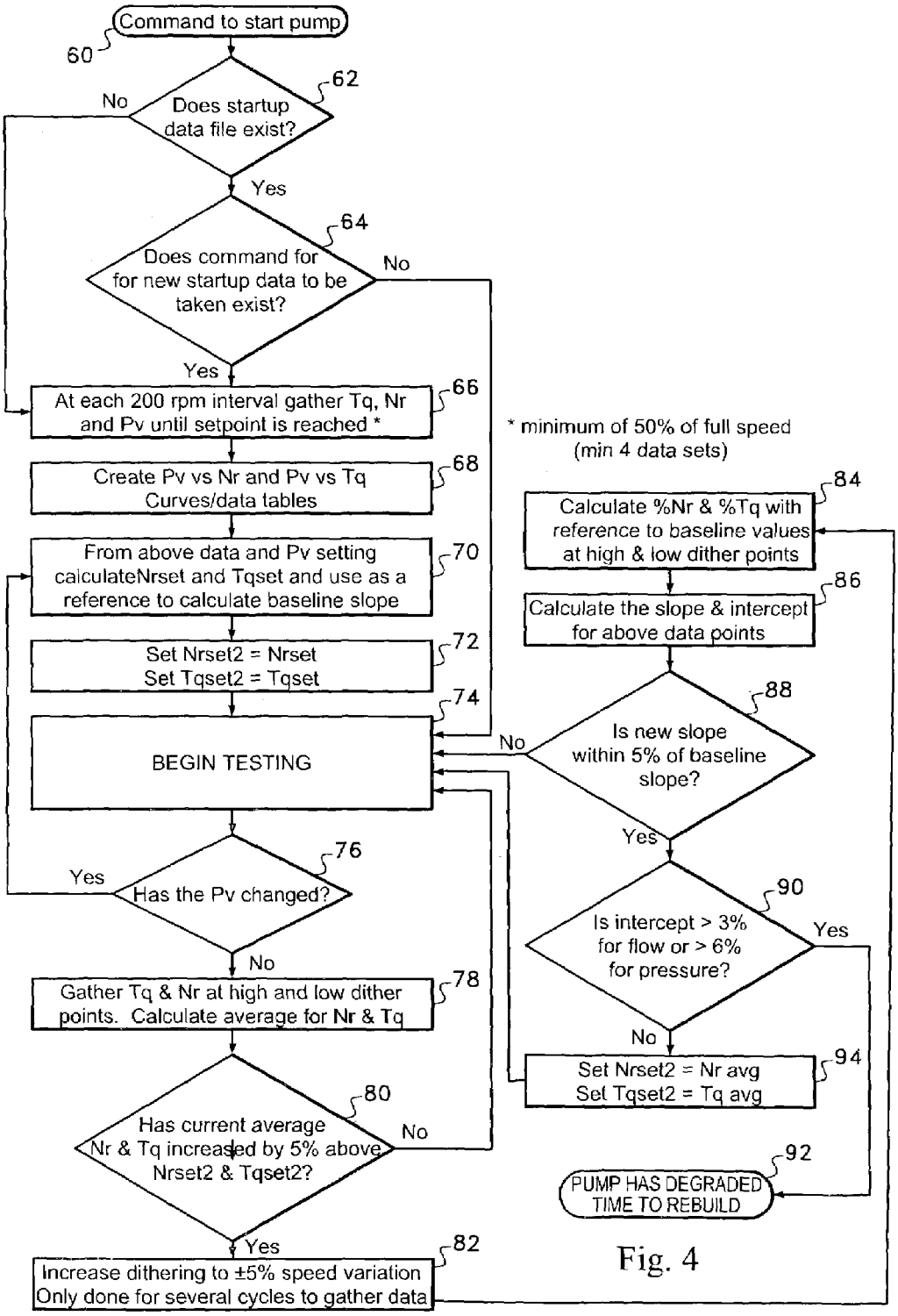
FIG. 4 is a flow diagram of a degradation test process.

With reference to FIG. 4, an exemplary flow diagram showing the operation of the processor relative to the pump, motor and variable speed drive is set forth as follows. The program includes essentially two routines a "characterize pump" routine and "test for degradation" routine. The program is preferably initiated at the start of pump operation at step 60. A check is made to determine whether a startup data file has already been created at step 62. If the file exists, a check is made to determine whether a user request to obtain new startup data has been made at step 64, if no request has been made, the program skips the "characterize pump" routine and jumps to step 74. Otherwise, the program collects startup data to establish an operating baseline at step 66.

"Characterize Pump" Routine

At step 66 the program collects driver to pump torque (Tq), pump speed (Nr) and process variable (Pv) data at regular predetermined intervals. For purposes of illustration the process variable is pressure and the data is collected at intervals where the pump speed increases by 200 RPM. The interval rate should be set so that preferably four data sets may be collected over generally at least 50% of the operating speed. This is where operating speed is either the maximum speed of the pump or at the pressure set point value. The decision as to whether to test to maximum speed or to the process variable set point may be an application specific decision. For example, where maintaining liquefaction is desirable, it maybe preferred to test to the process variable set point. Upon completing data collection, the functions for computing torque and speed relative to the process variable are derived by line fitting routines at step 68.

At step 70 using the functions for computing torque and speed as a function of the process variable and the process set point as a reference, a base data table is computed. From the base data table, the percent change in torque and percent change in speed values are calculated, plotted and a baseline 46 baseline slope with y-axis intercept point 48 is obtained as described above with reference to FIG. 2. With continued reference to FIG. 4, at step 72 the speed and torque values at the process variable set point are stored for use in the "test for degradation" routine. At step 74 the routine enters into a DO loop or performs other tasks while awaiting an interrupt signal to indicate that a "test for degradation" routine has been requested or should be initiated. The "test for degradation" routine may occur either at a predetermined interval or may be initiated manually by the user.

"Test For Degradation" Routine

At step 74, the "test for degradation" routine begins by first checking to ensure that the process variable set point has not changed at step 76. A change in the process variable set point could provide a false indication of degradation. If the process variable has changed the program returns to step 70 to calculate new values for speed and torque from the new process variable set point. Otherwise, the program continues to step 78 to collect test torque and speed data at the high and low dither points and calculates an average torque and speed value. If the average torque and speed value has not deviated by more than 5% of the torque and speed set point at step 80, then the pump performance has not changed sufficiently to warrant a degradation evaluation and the program returns to step 74. Otherwise, dithering is changed to high and low values relative to the speed at the process variable set point (Nrset). For example, FIG. 4 illustrates that the high and low values are at +/−5% of the speed at the process variable set point value. Data is then collected at step 82 for the process variable (Pvtest), torque (Tqtest) and speed (Nrtest) at the high, low and process variable set point values. It will be appreciated by those skilled in the art that the dithering data collection of step 82 may be repeated as needed for a particular process and the amount of data collected may be specific to the characteristics of the overall system. Upon collecting the data, the percent change in torque relative speed are calculated with reference to the baseline values at the high and low test points at step 84 using the formulas described with reference to FIG. 2 above. At step 86 the slope of the collected test data is computed along with the intercept to the y-axis (FIG. 3). With continued reference to FIG. 4, a check is made of the test slope to the baseline slope at step 88 and if the difference is greater than θ=5 degrees, system or suction changes are assumed to have occurred, the data is invalid and the routine returns to step 74. Otherwise, if the data is valid the intercept of the baseline and test line to the y-axis is compared at step 90. If the difference of the y-axis intercept of the baseline and the test line is greater than Δ=3% where the process variable is flow or greater than Δ=6% where the process variable is pressure, then pump degradation is assumed to have occurred and an alert or report is generated to the user at step 92. Given that the baseline slope intercepts the y-axis at or near zero, this computation maybe simplified by computing the difference of the y-axis intercept of the test slope from zero without any change in the percent difference threshold values for flow and pressure. It should be noted that the percentage difference may be increased in a system where pump degradation is not generally considered critical or may vary in accordance with the overall system operating parameters. If no degradation is found, the torque and speed set point are set to the average values of torque and speed acquired at step 94 and the routine returns to step 74.

Sample Results

Figure 5:
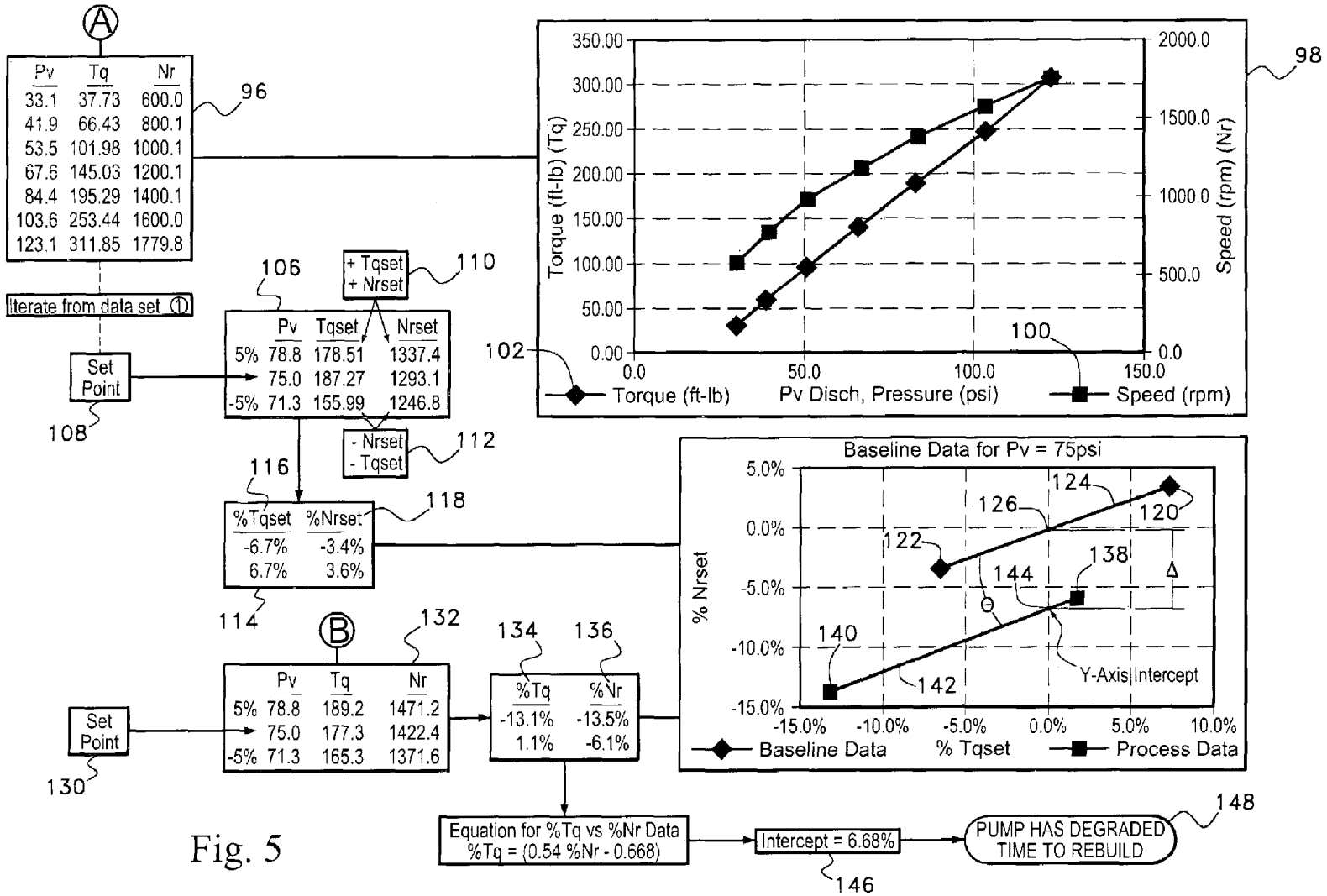
FIG. 5 is a block diagram of test data results while undergoing the process of FIG. 4.

With reference to FIG. 5, sample results of a degradated VSD pump using a pressure sensor as the process variable were taken at different stages of the software routine of FIG. 4. The "characterize pump" routine is initiated represented by "A" and the program determines that measurements are to be taken, the table 96 represents the Pv, Tq and Nr values measured during startup in which data was recorded at 200 rpm increments from 600 to ~1800 rpms at step 66 (FIG. 4). The results are then processed by the line fitting routine at step 68 (FIG. 4). The graph 98 (FIG. 5) represents the results of the line fitting routines that determine the functions that define speed 100 and torque 102 in relation to pressure. The torque and speed lines are computed using conventional linefitting techniques. The base data table 102 computed at step 70 (FIG. 4) is illustrated in block 106 where the pressure set point 108 is defined as 75 psi and the plus/minus 5 percent values of pressure are 78.8 and 71.3, respectively. Values for torque (Tqset) and speed (Nreset) as a function of the process variable set point 110, 112 and plus or minus percent of the process variable are also recorded in the table. From this data, the table 114 illustrating the percent difference in torque 116 and speed 118 is then computed at step 70 (FIG. 4) from the following formulas:

$$\%\ Tq\text{set}=(Tq\text{set}-Tq\text{set}_{@\pm 5\%\ Pvset})/Tq\text{set}*100$$

$$\%\ Nr\text{set}=(Nr\text{set}-Nr\text{set}_{@\pm 5\%\ Pvset})/Nr\text{set}*100$$

The percent difference in torque and speed for the plus/minus 5 percent of the pressure set point are plotted 120, 122 and a baseline 124 is drawn between the two points. The baseline slope and y-axis intercept 126 is then computed.

During the "test for degradation" routine the pressure measurements where made at the pressure set point 130 value of 75 psi and at dither rates of plus/minus 5 percent of the pressure set point value. These results differ slightly from the FIG. 4 flow diagram step 82 as dithering is described at plus/minus 5 percent of speed. It will be appreciated that any of the measured results for process variable, torque or speed may be used to determine the high and low dither point during data collection without detracting from the invention. The collected data is tabulated 132 and is then used to determine the percent difference in torque 134 and speed 136 at step 84 (FIG. 4) from the following formulas:

$$\%\ Tq\text{test}=(Tq\text{set}-Tq\text{test}_{LOW/HIGH})/Tq\text{set}*100$$

$$\%\ Nr\text{test}=(Nr\text{set}-Nr\text{test}_{LOW/HIGH})/Nr\text{set}*100$$

The percent difference in torque and speed for the high and low measured values are plotted 138, 140 and a testline 142 is drawn between the two points. The baseline slope and y-axis intercept 144 is then computed at step 86 (FIG. 4). In the present example the difference in the baseline slope is below θ=5 degrees at step 88 (FIG. 4), but the difference (Δ) in the y-axis intercept 146 is found to be above 6% at step 90 (FIG. 4), thus the program would report 148 that the pump has degraded at step 92 (FIG. 4).

The data, as shown in FIGS. 2, 3 and 5, can be automatically obtained and stored in memory of the processor for each pump. It will be appreciated that the cost of manually configuring the processor to operate with a particular pump has been eliminated. The technique can be employed as a redundant check of any of similar pump devices, thereby further reducing false alarms caused by faulty or disconnected sensors.

Figure 6:
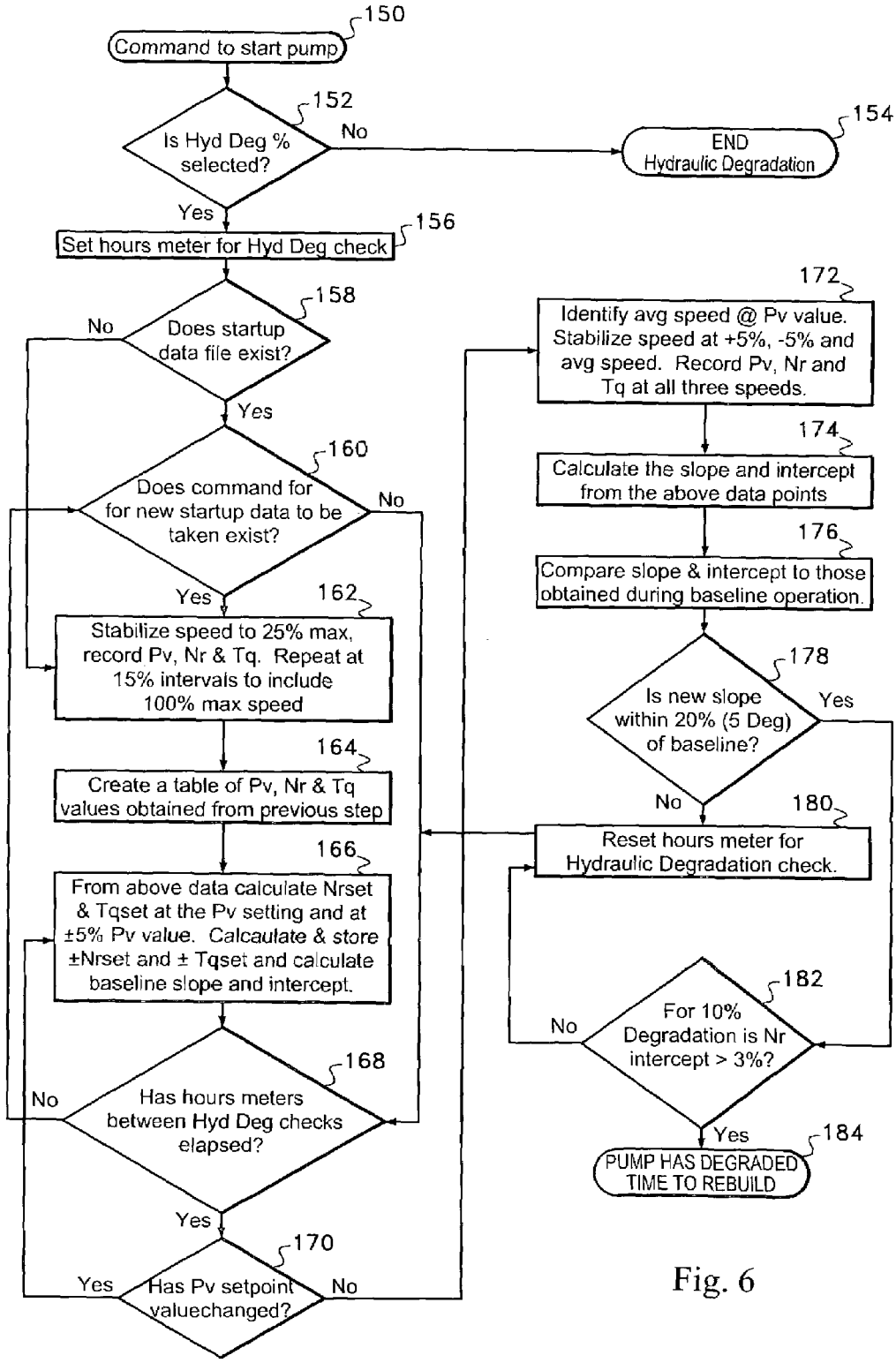
FIG. 6 is an alternate flow diagram of a degradation test process.

With reference to FIG. 6, an alternate exemplary flow diagram showing the operation of the processor relative to the pump, motor and variable speed drive is set forth as follows. The program illustrated in FIG. 6, like the flow diagram of FIG. 4, includes two routines, namely, a "characterize pump" routine and "test for degradation" routine. This alternate program provides different data collection routines in the "characterize pump" routine and allows for the user to selectively turn this feature off. The program is preferably initiated at the start of pump operation at step 150. A check is made to determine whether the user has selected pump degradation as an option at step 152. The user selection can be in the form of a flag or other conventional programming switch. In one embodiment, the user may be requested to enter a percentage of pump degradation as such a threshold may be application specific to the system in which the pump is operating. If the degradation option has not been selected, then the program terminates at step 154. Otherwise, an hour meter variable is set at step 156 to establish the time interval between "test for degradation" routines". This variable can be entered by the user or may be a default value provided by the software. A check is made to determine whether a startup data file has already been created at step 158. If no file exists the program jumps to step 162. Otherwise, if the file exists a check is made to determine whether a user request to obtain new startup data has been made at step 160, if no request has been made, the program skips the "characterize pump" routine and jumps to step 168. Otherwise, the program collects startup data to establish an operating baseline at step 162.

"Characterize Pump" Routine

At step 162, the program stabilizes the motor speed at 25% of the maximum speed, where the maximum speed of a VFD installed in a system is generally set at the max speed tolerated by the system parameters in which the pump operates. Then, the program measures and records the process variable (Pv), speed (Nr) and driver to pump torque (Tq). The speed is then incrementally increased by 15% of the maximum speed and the measurements are repeated. This sequence is repeated until measurements are made at 100% of the maximum speed. It will be appreciated that this data collection approach allows for the program to collect six measurements every time regardless of changes in maximum speed. The program of FIG. 4 relies upon a constant value such as 200 rpms to increment speed and, for low maximum speeds, runs the risk of collecting less than four measurements. This problem has been eliminated in the present embodiment of FIG. 6. Upon completing data collection, the torque and speed are respectively tabulated against the collected process variable data for each data set at step 164.

At step 166, using the functions for computing torque and speed as a function of the process variable and the process set point as a reference, the base data table is computed. Then the percent change in torque versus percent change in speed values are calculated, plotted and a baseline 46, baseline slope with y-axis 48 intercept point is obtained as described with reference to FIG. 2 above. The base data and baseline information is saved for use in the "test for degradation" routine. At step 168 the routine enters into a DO loop or performs other tasks and awaits an interrupt to indicate that time has elapsed equal to or greater than the time interval defined in the hours meters variable. Upon completing the loop or upon receiving an interrupt signal, the "test for degradation" routine is initiated.

"Test For Degradation" Routine

Once the processor has triggered the "test for degradation" routine at step 168, the "test for degradation" routine first checks to ensure that the process variable set point has not changed at step 170. A change in process variable set point could provide a false indication that degradation has occurred. If the process variable has changed the program returns to step 166 to calculate new values for speed (Nrset) and torque (Tqset) using the new process variable set point (Pvset). Otherwise, the program continues to step 172 to collect torque and speed data at the process variable set point and an average speed value is determined. The pump is then dithered at ±5 percent of the average speed value. The process variable (Pvtest), torque (Tqtest) and speed (Nrtest) is measured and recorded at three speeds, namely, the process variable set point average speed, +5 percent of average speed (high) and −5 percent of average speed (low). At step 174, the percent change in torque relative to speed data are calculated with reference to the baseline values at the high and low test points using the formulas discussed above. The high and low test points are then plotted to establish a test line and the slope of the test line is computed along with the intercept to the y-axis (FIG. 3). With continued reference to FIG. 6, a check is made of the test line slope to the baseline slope at step 176 and if the difference (Δ) is greater than 5 degrees (20%) at step 178, then system or suction changes are assumed to have occurred, the data is invalid and the hours meter variable is reset at step 180 and the routine returns to step 168. Otherwise, if the data is valid the difference of the y-axis intercept of the baseline and test line is computed at step 182. If the difference is greater than Δ=3% from the set point where the process variable is flow or greater than Δ=6% where the process variable is pressure, then a 10% pump degradation is assumed to have occurred and an alert or report is generated to the user at step 184. The values given here at step 184 are typical values for end suction style pumps. It should be noted that the percentage difference may be increased in system where pump degradation is not generally considered critical or may varied in accordance with the overall system operating parameters. Otherwise, the hours meter variable is reset at step 180 and the routine returns to step 168.

Figure 7:
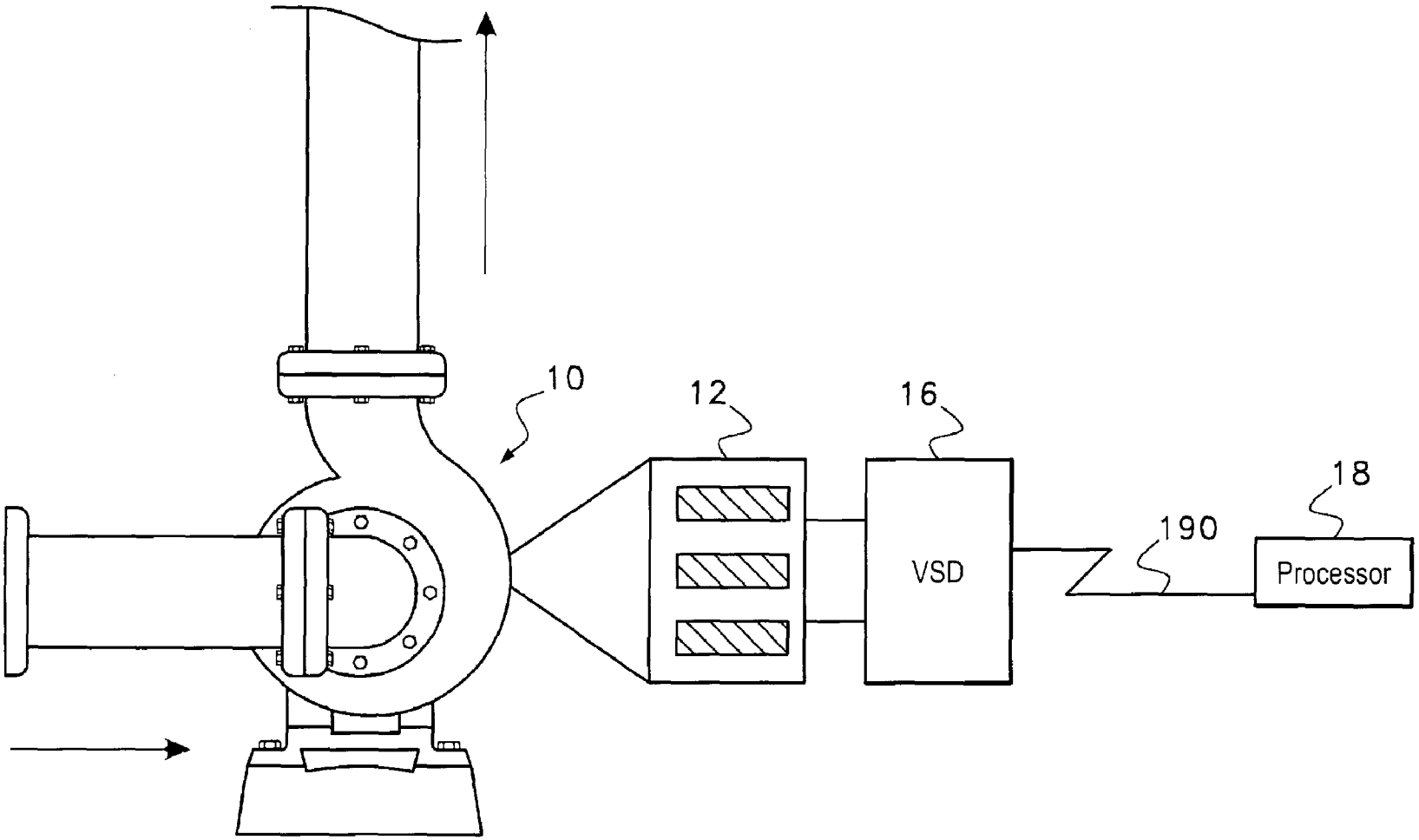
FIG. 7 is an alternate schematic depicting a centrifugal pump having a variable speed drive according to an aspect of this invention.

With reference to FIG. 7, an alternate embodiment is shown wherein the processor 18 may be located remotely with the pump assembly having a pump 10, motor 12 and variable speed drive 16 wherein the processor 18 is in signal communication represented by line 190 with the variable speed drive. The signal communication means 190 may include a data cable or wireless communication as well as remote dial-in communication via a telephone line.

Figure 8:
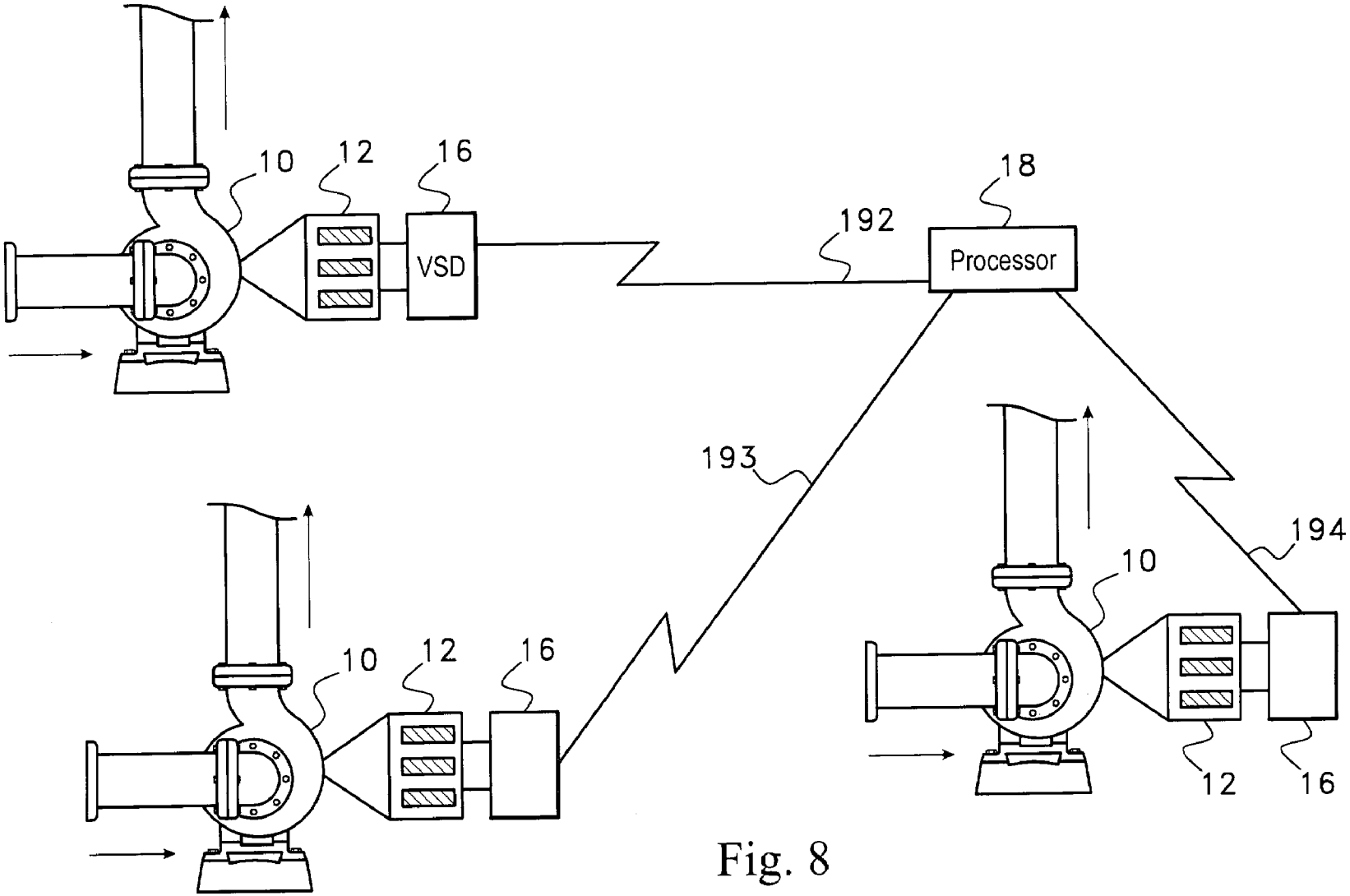
FIG. 8 is an alternate schematic depicting a centrifugal pump having a variable speed drive according to an aspect of this invention.

With reference to FIG. 8, an alternate embodiment is shown wherein the processor 18 may be located remotely from a plurality of pump assemblies having a pump 10, motor 12 and variable speed drive 16. The processor 18 is in signal communication represented by lines 192–194 with each of the pump assemblies. It will be appreciate that the processor may be used to test for degradation on each of the pumps by automatically obtaining the pump operating characteristics without the need for manually entered data. The signal communication means may include any combination of the means discussed with respect to FIG. 7 above or any other signal communication means later conceived.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A method performed by a processor of determining degradation of the performance of a centrifugal pump assembly having a pump driven by a motor with a variable speed drive comprising the steps of:

characterizing pump torque and speed relative to a process variable set point by determining a torque and speed set point relative to said process variable set point; and testing for degradation of said pump performance relative to said characterized pump torque and speed.

2. The method of claim 1 wherein said characterizing step is initiated automatically upon start-up of said pump.

3. The method claim 1 wherein said characterizing step includes the step of measuring pump torque, speed, and at least one process variable to obtain a data set.

4. The method of claim 3 wherein the measuring step is repeated.

5. The method of claim 3 wherein the measuring step is repeated at least three times.

6. The method of claim 5 wherein measuring steps are repeated upon equal incremental changes in pump speed.

7. The metod of claim 1 wherein said process variable is selected from the group consisting of pressure and flow.

8. The method of claim 1 wherein said testing step includes dithering said pump.

9. The method of claim 8 wherein said testing step includes measuring pump torque and speed during dithering and comparing said measured torque and speed to characterized torque and speed to determine degradation.

10. The method of claim 8 wherein said testing step includes measuring pump torque and speed during dithering and comparing a percent change in measured speed over torque relative to characterized speed and torque with a percent change in characterized speed over torque to determine degradation.

11. A method for determining degradation of a centrifugal pump independent of using hydraulic information associated with said pump, and therefore independent of the pump, comprising the steps of:

automatically characterizing said pump torque and speed relative to a process variable set point by measuring and recording pump torque, pump speed and said process variable at regular intervals during start-up of said pump and determining, from said recorded pump torque, pump speed and process variable, a pump torque and speed at said process variable set point; and testing for degradation of said pump performance relative to said characterized torque and speed by measuring and recording pump torque and speed and said process variable while dithering operation of said pump and, upon completion of dithering said pump, comparing said recorded pump torque and speed during dithering to said characterized torque and speed to determine degradation.

12. A device for monitoring a pump assembly having a variable speed drive motor comprising:

sensors for monitoring pump speed, torque and at least one process variable;

a processor in signal communication with said sensors and said variable speed drive motor;

software for use by said processor to characterize pump torque and speed relative to an operational threshold by determining a torque and speed set point relative to said operational threshold and to test for degradation of said pump performance relative to said characterized pump torque and speed.

13. The device of claim 12 wherein said operational threshold is a process variable set point.

14. The device of claim 12 wherein said operational threshold is a process variable threshold selected from the group consisting of pressure and flow.

15. The device of claim 12 wherein said processor is included in said variable speed drive motor.

16. The device of claim 12 wherein said processor is located remotely from said pump assembly and is connected by communication means.

17. The device of claim 12 wherein said processor is connected to a plurality of pump assemblies.

18. The device of claim 12 including means for reporting pump degradation.

19. A method performed by a processor of determining degradation of the performance of a centrifugal pump assembly having a pump driven by a motor with a variable speed drive comprising the steps of:

characterizing pump torque and speed relative to a process variable set point;

dithering said pump; and testing for degradation of said pump performance relative to said characterized pump torque and speed.

20. A device for monitoring a pump assembly having a variable speed drive motor comprising:

sensors for monitoring pump speed, torque and at least one process variable;

a processor in signal communication with said sensors and said variable speed drive motor;

software for use by said processor to characterize pump torque and speed relative to an operational threshold, dither said pump, and test for degradation of said pump performance relative to said characterized pump torque and speed.

* * * * *